US005986226A

United States Patent [19]

Jani

[11] Patent Number: 5,986,226

[45] Date of Patent: Nov. 16, 1999

[54] DUAL FUNCTION SWITCH

[76] Inventor: Rajnikant S. Jani, 1763 Hemlock Dr., Glendale Heights, Ill. 60139

[21] Appl. No.: 09/014,114

[22] Filed: Jan. 27, 1998

[51] Int. Cl.[6] ..... H01H 3/16

[52] U.S. Cl. ..... 200/338; 200/47; 200/61.41; 200/573; 200/334

[58] Field of Search ..... 200/4, 16 R–16 C, 200/47, 61.13, 61.14, 61.15, 61.17, 61.41, 61.18, 61.42, 573, 574, 332, 334, 338

*Primary Examiner*—Michael Friedhofer
*Attorney, Agent, or Firm*—Dillis V. Allen, Esq.

[57] ABSTRACT

A micro switch for detecting forces in two orthogonal directions, rather than one, useable, for example, to detect out of size parts in one plane in a multiple spindle screw machine, and disengaged parts in an orthogonal plane. This is accomplished through the provision of a ramp that is slidably engaged by the switch's actuation rod as the rod moves in a first plane to translate sideway movement of the rod into perpendicular linear movement of the switch's plunger. The ramp has a recess that captures the rod as it moves in the orthogonal plane, which is coincident with the axis of the plunger, thereby causing switch actuation with plunger movement in two planes.

10 Claims, 2 Drawing Sheets

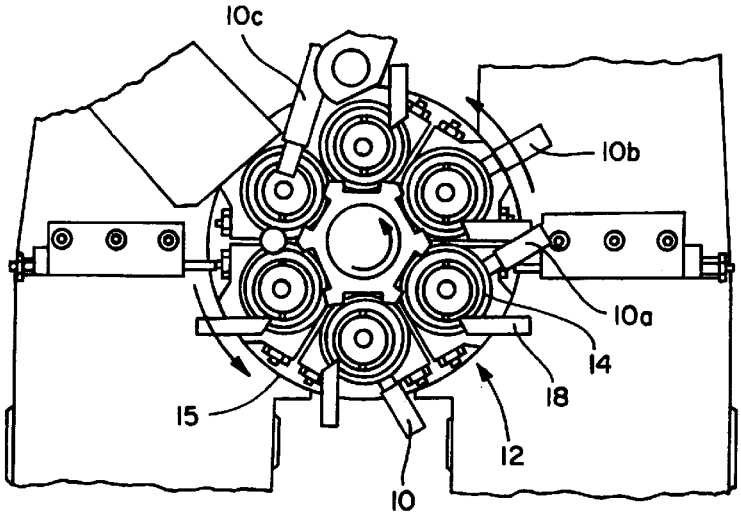
Fig. 1
Fig. 2
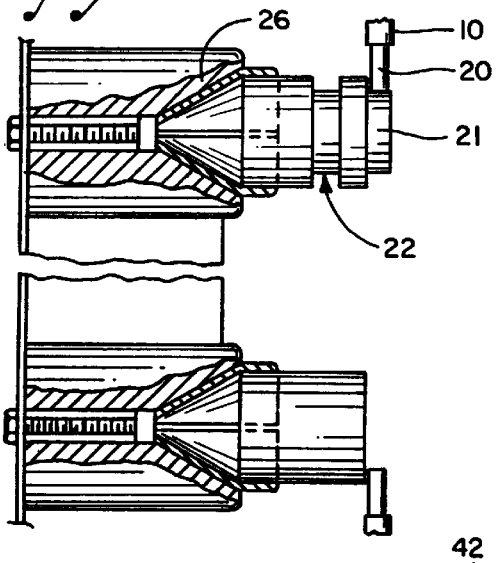
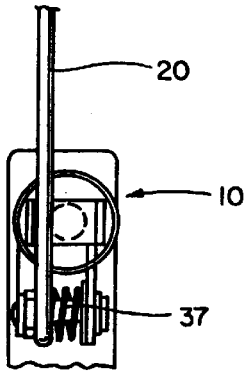
Fig. 3
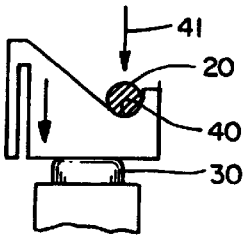
Fig. 4
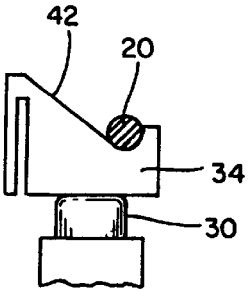
Fig. 5
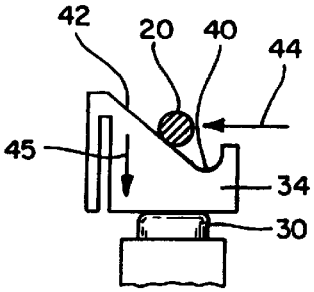
Fig. 6

DUAL FUNCTION SWITCH

BACKGROUND OF THE INVENTION

In multiple spindle screw machines, there are two distinct conditions that require machine shut-down. The first is a failure to properly turn the workpiece at any station and the second is the inadvertent disengagement of a part at any station. An automatic shut-down system for these conditions is desirable because it is difficult for a single operator to immediately view both of these conditions at all stations, frequently six or eight in number. It is possible to have two systems at each station to accomplish these tasks, such as a gauge to measure part diameter and a separate sensing barrier to detect part disengagement, but such systems are costly and hence tool buyers do not usually select these systems, particularly in cases where great precision is not required.

However, they both remain significant problems because they result in a high number of damaged parts if not detected immediately, and also broken tools.

Thus, it is a primary object of the present invention to ameliorate the problems noted above in systems for detecting conditions in two directions.

SUMMARY OF THE PRESENT INVENTION

In accordance with the present invention, a simple micro switch, usually responsive to forces in a single direction, is modified to perform two functions rather than one.

One application for the switch is as a shut-off switch for a multiple spindle screw machine. Two problems exist in such machines. The first is a broken tool at any station produces out of size parts. The other is part of it frequently becomes disengaged from the spindle and flies axially from the machine causing the tool holder to also break. If the machine is not stopped, subsequent stations can also be damaged when the collet breaks. A micro switch according to the present invention is mounted at each station in a position to detect both conditions with a single switch.

Toward these ends, the micro switch according to the present invention includes a switch body, a plunger reciprocal in the body, and an actuator rod for the plunger pivotally mounted on the outside of the body biased toward the plunger by a torsion spring.

A ramp is also pivotally mounted on the switch body about the same axis and sits over and moves the plunger axially to actuate the switch. Its ramp surface is slidably engaged by the actuator rod when it moves in a first direction perpendicular to the plunger, causing the ramp to move in the direction of the plunger, thereby depressing the plunger and causing switch action. The ramp has a recess that holds the rod when it moves in a second orthogonal direction so the rod, the ramp, and the plunger all move in the same direction, again causing switch actuation.

Other objects and advantages will appear more clearly from the following detailed description.

BRIEF DESCRIPTION OF THE DRAWINGS

FIG. 1 is a right side view of a multiple spindle screw machine with safety switches according to the present invention installed;

FIG. 2 is a fragmentary front sectional view about two stations in the screw machine illustrated in FIG. 1, showing safety switch mounting locations at those stations;

FIG. 3 is a top view of the dual function switch according to the present invention;

FIG. 4 is a fragmentary end view of the dual function switch actuated by a force in a first planar direction;

FIG. 5 is a fragmentary view of the present dual function switch in its Off position;

FIG. 6 is a fragmentary view of the present dual function switch shown in FIGS. 4 and 5 in its actuated position by a force in a direction perpendicular to the applied force in FIG. 4;

DETAILED DESCRIPTION OF THE PREFERRED EMBODIMENTS

Figure 7:
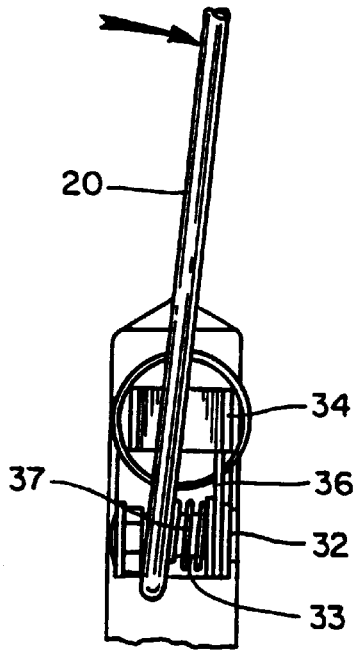
FIG. 7 is a top view of the present dual function switch with a force illustrated in FIG. 6.

Referring to the drawings and particularly FIGS. 1 and 2, the present dual function switches 10*a*, 10*b*, and 10*c* are shown installed at each station of a multiple spindle screw machine 12, that generally includes six rotary spindles 14 on a rotatable turret 15, and a plurality of cutting tools 18, one mounted at each of the stations.

As seen in FIG. 2, the dual function switch 10 includes a pivotal plunger rod 20 that measures one diameter 21 of a part 22 at each station. That is, the position of the switch 10 changes axially with respect to the part and measures a different diameter at each station. In the event that the diameter 21, or any other diameter, is not properly machined, it engages rod 20, as the turret indexes counter-clockwise as viewed in FIG. 1, and rotates it in the direction illustrated in FIG. 4, actuating the switch 10 which shuts off the screw machine 12.

The switch 10 is also actuated in the event that the part 22 disengages itself from spindle 26 and moves in an axial direction engaging the side of the rod 20 and twists it in the direction illustrated in FIGS. 6 and 7, also causing switch actuation.

As seen in FIGS. 3, 7, 8 and 9, the present switch 10 is a micro switch including a switch body 28, a linearly reciprocable plunger 30, and an actuating rod 20 pivotally mounted on axis 31 on an arm 32 projecting outwardly from switch body 28, and a ramp member 34 that translates movement of the actuator rod 20 in two orthogonal directions into linear actuating movement of the reciprocable plunger 30.

Figure 8:
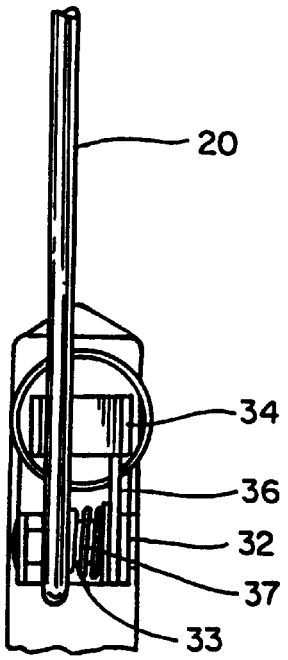
FIG. 8 is a top view of the present dual function switch in the position illustrated in FIG. 5.

As seen in FIGS. 7 and 8, the arm 32, which is bifurcated, has a post 33 fixed therein about which end 34 of rod 20 is looped so that the rod is pivotally mounted on post 33. A ramp arm 36 is also pivotally mounted on post 33, and it carries the ramp member 34 at its distal end with the bottom of the ramp member engaging the end of the reciprocal plunger 30.

Figure 9:
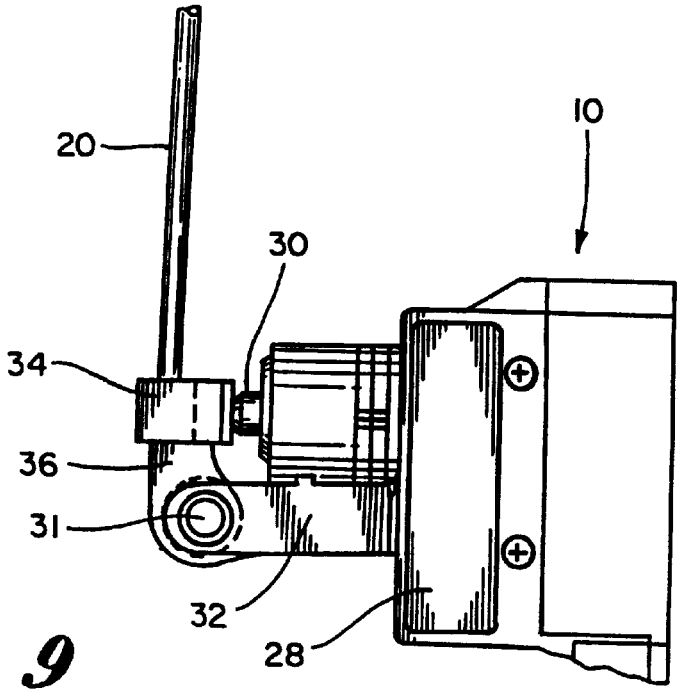
FIG. 9 is a front view of the present dual function switch.

A torsion spring 37 is carried on post 33 and engages and biases the rod 20 in a clockwise direction as viewed in FIG. 9. The rod 20 in turn biases the ramp member 34 against the outer or top surface of the plunger 30.

As seen in FIGS. 4, 5, and 6, the ramp 34 has a recess 40 having a radius approximating that of the rod 20 so that when a force is applied in the direction of arrow 41 in FIG. 4, the rod 20 moves into the recess 40 and drives the plunger 30 downwardly to its position in FIG. 4, which is the switch actuation position. The plunger 30 is shown in its Off or unactuated position in FIG. 5. Ramp member 34 has a planar ramp surface 42 extending upwardly and outwardly from recess 40 at an angle of about 30 to 40 degrees with respect to a horizontal plane perpendicular to the planes of FIGS. 4, 5 and 6.

As a force is applied to the rod 20, in the direction of arrow 44 in FIG. 6, which is orthogonally disposed with respect to arrow 41, the rod 20 slides up the ramp surface 42, causing the ramp member 34 to move in the direction of arrow 45, causing switch plunger 30 to move to the actuated position in FIG. 6.

The torsion spring 37 also functions, as seen in FIG. 3, to return the rod 20 to the recess 40 when no force is applied to the distal end of the rod 20.

I claim:

1. A switch for detecting forces in two generally orthogonal directions, comprising: a switch body having terminals and a plunger member linearly reciprocable on a predetermined axis, an elongated actuator member including a rod pivotally mounted on an axis on the switch body and extending generally transverse to the predetermined axis of the plunger member on the body constructed to actuate the plunger member by actuator member movement in two generally orthogonal directions with one of the two directions being the predetermined axis of the plunger member, and means engaging but separately mounted from the rod to translate movement of the rod in the two orthogonal directions into plunger member linear movement along the predetermined axis, whereby movement of the actuator member in either of the two directions causes switch actuation.

2. A switch for detecting forces in two generally orthogonal directions as defined in claim 1, wherein the rod is pivotally mounted on an axis on the switch body in a plane substantially coincident with the predetermined axis, pivotal movement of the actuator member defining one of the two orthogonal movements of the actuator member, said other orthogonal movement of the actuator member being generally perpendicular to said plane.

3. A switch for detecting forces in two generally orthogonal directions as defined in claim 2, said means to translate movement of the rod in the two orthogonal directions into linear movement of the plunger member including ramp means mounted for movement adjacent the plunger member, said ramp means having a surface slidably engaging the rod when the rod moves in the other orthogonal direction causing the ramp means to depress the plunger member.

4. A switch for detecting forces in two generally orthogonal directions, comprising: a switch body having terminals and a plunder member linearly reciprocable on a predetermined axis, an elongated actuator member on the body constructed to actuate the plunger member by actuator member movement in two generally orthogonal directions, and means to translate movement of the elongated actuator member in the two orthogonal directions into plunger member linear movement along the predetermined axis, whereby movement of the actuator in either of the two directions causes switch actuation, wherein the actuator member is a rod pivotally mounted on an axis on the switch body in a plane substantially coincident with the predetermined axis, said pivotal movement of the actuator member defining one of the two orthogonal movements of the actuator member, said other orthogonal movement of the actuator member being generally perpendicular to said plane, said means to translate movement of the rod in the two orthogonal directions into the linear movement of the plunger member including ramp means mounted for movement adjacent the plunger member, said rams means having a surface slidably engaging the rod when the rod moves in the other orthogonal direction causing the ramp means to depress the plunger member, said ramp means having a recess for receiving the rod when the rod moves in the one orthogonal direction causing the ramp means to depress the plunger member.

5. A switch for detecting forces in two generally orthogonal directions as defined in claim 4, wherein the ramp means is pivotally mounted on the switch body about the axis of the actuator member.

6. A switch for detecting forces in two generally orthogonal directions, comprising: a switch body having terminals and a plunger member linearly reciprocable on a predetermined axis, an elongated actuator member on the body constructed to actuate the plunger member by actuator member movement in two generally orthogonal directions, and means to translate movement of the elongated actuator member in the two orthogonal directions into plunger member linear movement along the predetermined axis, whereby movement of the actuator in either of the two directions causes switch actuation, wherein the actuator member is a rod pivotally mounted on an axis on the switch body in a plane substantially coincident with the predetermined axis, said pivotal movement of the actuator member defining one of the two orthogonal movements of the actuator member, said other orthogonal movement of the actuator member being generally perpendicular to said plane, and a torsion spring on the pivotal axis of the actuator member for biasing the actuator member toward the plunger member.

7. A safety system for shutting down a multiple spindle screw machine if parts are either improperly machined at any station or become disengaged from collets, comprising: a plurality of safety switches for detecting part size in one direction and part disengagement in an orthogonal direction each including a plunger member linearly reciprocable on a predetermined axis, an elongated actuator member on the body including a rod pivotally mounted on an axis on the switch body and extending generally transverse to the predetermined axis of the plunger member constructed to actuate the plunger member by actuator member movement in two generally orthogonal directions with one of the two directions being the predetermined axis of the plunger member, and means engaging but separately mounted from the rod to translate movement of the rod in the two orthogonal directions into plunger member linear movement along the predetermined axis, whereby movement of the actuator member in either of the two directions causes switch actuation.

8. A safety system for shutting down a multiple spindle screw machine as defined in claim 7, wherein the rod is pivotally mounted on an axis on the switch body in a plane substantially coincident with the predetermined axis, pivotal movement of the actuator member defining one of the two orthogonal movements of the rod, said other orthogonal movement of the rod being generally perpendicular to said plane, said means to translate movement of the rod in the two orthogonal directions into linear movement of the plunger member including ramp means mounted for movement adjacent the plunger member, said ramp means having a surface slidably engaging the rod when the rod moves in the other orthogonal direction causing the ramp means to depress the plunger member.

9. A safety system for shutting down a multiple spindle screw machine if parts are either improperly machined at any station or become disengaged from collets, comprising: a plurality of safety switches for detecting part size in one direction and part disengagement in an orthogonal direction each including a plunger member linearly reciprocable on a predetermined axis, an elongated actuator member on the body including a rod pivotally mounted on an axis on the switch body and extending generally transverse to the predetermined axis of the plunger member constructed to actuate the plunger by actuator member movement in two generally orthogonal directions, and means to translate movement of the elongated actuator member in the two orthogonal directions into plunger member linear movement along the predetermined axis, whereby movement of the actuator member in either of the two directions causes switch actuation, the actuator member being pivotally mounted on an axis on the switch body in a plane substantially coincident with the predetermined axis, pivotal movement of the actuator member defining one of the two orthogonal movements of the rod, said other orthogonal movement of the rod being generally perpendicular to said plane, said means to translate movement of the rod in the two orthogonal directions into linear movement of the plunger member including ramp means mounted for movement adjacent the plunger member, said ramp means having a surface slidably engaging the rod when the rod moves in the other orthogonal direction causing the ramp means to depress the plunger member, said ramp means having a recess for receiving the rod when the rod moves in the one orthogonal direction causing the ramp means to depress the plunger member, the ramp means being pivotally mounted on the switch body about the axis of the rod, and a torsion spring on the pivotal axis of the rod for biasing the rod toward the plunger member.

10. A switch for detecting forces in two generally orthogonal directions, comprising: a switch body having terminals and a plunger member linearly reciprocable on a predetermined axis, an elongated actuator member including a rod pivotally mounted on an axis on the switch body and extending generally transverse to the predetermined axis of the plunger member on the body constructed to actuate the plunger member by actuator member movement in the two generally orthogonal directions with one of the two directions being the predetermined axis of the plunger member, and means to translate movement of the elongated actuator member in the two orthogonal directions into plunger member linear movement along the predetermined axis, whereby movement of the actuator member in either of the two directions causes switch actuation, wherein the actuator member is pivotally mounted on the switch body in a plane containing the predetermined axis, pivotal movement of the actuator member defining one of the two orthogonal movements of the actuator member, said other orthogonal movement of the actuator member being generally perpendicular to said plane, said means to translate movement of the rod in the two orthogonal directions into linear movement of the plunger member including ramp means mounted for movement adjacent the plunger member, said ramp means having a surface slidably engaging the rod when the rod moves in the other orthogonal direction causing the ramp means to depress the plunger member.

* * * * *